US007740671B2

(12) United States Patent
Yows et al.

(10) Patent No.: US 7,740,671 B2
(45) Date of Patent: Jun. 22, 2010

(54) DUMP COOLED GASIFIER

(75) Inventors: Stephen Arthur Yows, Moorpark, CA (US); Steven P. Fusselman, Simi Valley, CA (US)

(73) Assignee: Pratt & Whitney Rocketdyne, Inc., Canoga Park, CA (US)

( * ) Notice: Subject to any disclaimer, the term of this patent is extended or adjusted under 35 U.S.C. 154(b) by 254 days.

(21) Appl. No.: 11/640,661

(22) Filed: Dec. 18, 2006

(65) Prior Publication Data

US 2008/0141913 A1 Jun. 19, 2008

(51) Int. Cl.
*F23M 5/08* (2006.01)

(52) U.S. Cl. ..... 48/67; 48/62 R; 48/89; 48/119

(58) Field of Classification Search ..... 165/81–83
See application file for complete search history.

(56) References Cited

U.S. PATENT DOCUMENTS

| | | | | |
|---|---|---|---|---|
| 3,918,255 | A | 11/1975 | Holden | |
| 3,954,389 | A | 5/1976 | Szetela | |
| 4,272,255 | A * | 6/1981 | Coates | 48/63 |
| 4,362,500 | A | 12/1982 | Eriksson et al. | |
| 4,520,760 | A | 6/1985 | Covell | |
| 5,567,398 | A * | 10/1996 | Ruhl et al. | 422/197 |
| 5,976,203 | A * | 11/1999 | Deeke et al. | 48/62 R |
| 6,418,973 | B1 | 7/2002 | Cox et al. | |
| 6,920,836 | B2 | 7/2005 | Sprouse | |
| 2005/0051299 | A1 * | 3/2005 | Graham | 165/82 |
| 2005/0072341 | A1 * | 4/2005 | Sprouse | 110/336 |
| 2006/0210457 | A1 | 9/2006 | Sprouse et al. | |

FOREIGN PATENT DOCUMENTS

| | | |
|---|---|---|
| DE | 4230124 | 3/1994 |
| EP | 0284762 | 5/1988 |
| EP | 0351563 | 1/1990 |
| EP | 1717295 | 11/2006 |
| GB | 2093175 | 8/1982 |
| WO | WO 9514527 | 6/1995 |
| WO | WO 2007125047 | 11/2007 |

* cited by examiner

*Primary Examiner*—Alexa D Neckel
*Assistant Examiner*—Imran Akram
(74) *Attorney, Agent, or Firm*—Kinney & Lange, P.A.

(57) ABSTRACT

A dump-cooled gasifier includes a vessel, a liner, and coolant. The liner has a head end, an aft end, and a plurality of channels extending along a length of the vessel. The aft end of the liner is axially and radially expandable with respect to the head end of the liner. The coolant enters at the head end of the liner, flows through the liner, and is expelled from the aft end of the liner directly into the vessel.

10 Claims, 4 Drawing Sheets

DUMP COOLED GASIFIER

BACKGROUND OF THE INVENTION

The gasification process involves turning coal or other carbon-containing materials into synthesis gas. Because coal costs less than natural gas and oil, there is a large economic incentive to develop gasification technology. An issue with existing gasification technologies is that they generally have high capital costs and/or relatively low availability. Availability refers to the amount of time the equipment is on-line and making products. One cause of low availability is complex or short-lived gasifier liner designs. Examples of liners currently being used in gasifiers are refractory liners, membrane liners, and regeneratively cooled liners. Refractory liners require annual replacement of the refractory, with an availability of approximately 90%. While membrane liners have a longer life than refractory liners, the complexity of the liner can increase the cost of the gasifier up to 2 to 3 times.

Regeneratively cooled liners are also used in the gasification process and generally present a lower cost, longer life alternative to refractory liners and membrane liners. These benefits are a result of freezing a layer of slag on the wall of the regeneratively cooled liner. Regeneratively cooled liners can significantly reduce the cost of electricity, hydrogen, and synthesis gas produced by gasification plants when compared to gasification plants using refractory liners and membrane liners. An example of a regeneratively cooled liner is disclosed in U.S. Pat. No. 6,920,836 (Sprouse), which is herein incorporated by reference.

While regeneratively cooled liners provide significant benefits in gasification technology when compared to refractory liners and membrane liners, one of the technical challenges of using regeneratively cooled liners is managing the thermal growth of the liner. The liner, which may be formed of ceramic, is usually attached to a metal backing structure of the gasifier. Thus, as the temperature inside the gasifier increases, the rates of thermal expansion of the ceramic liner and the metal backing structure are mismatched.

Another challenge with regard to regeneratively cooled liners is the specific implementation of the metal/ceramic joining required to establish a closed-loop (regenerative) cooling circuit.

BRIEF SUMMARY OF THE INVENTION

A dump-cooled gasifier includes a vessel, a liner, and coolant. The liner has a head end, an aft end, and a plurality of channels extending along a length of the vessel. The aft end of the liner is axially and radially expandable with respect to the head end of the liner. The coolant enters at the head end of the liner, flows through the liner, and is expelled from the aft end of the liner directly into the vessel.

DETAILED DESCRIPTION

Figure 1:
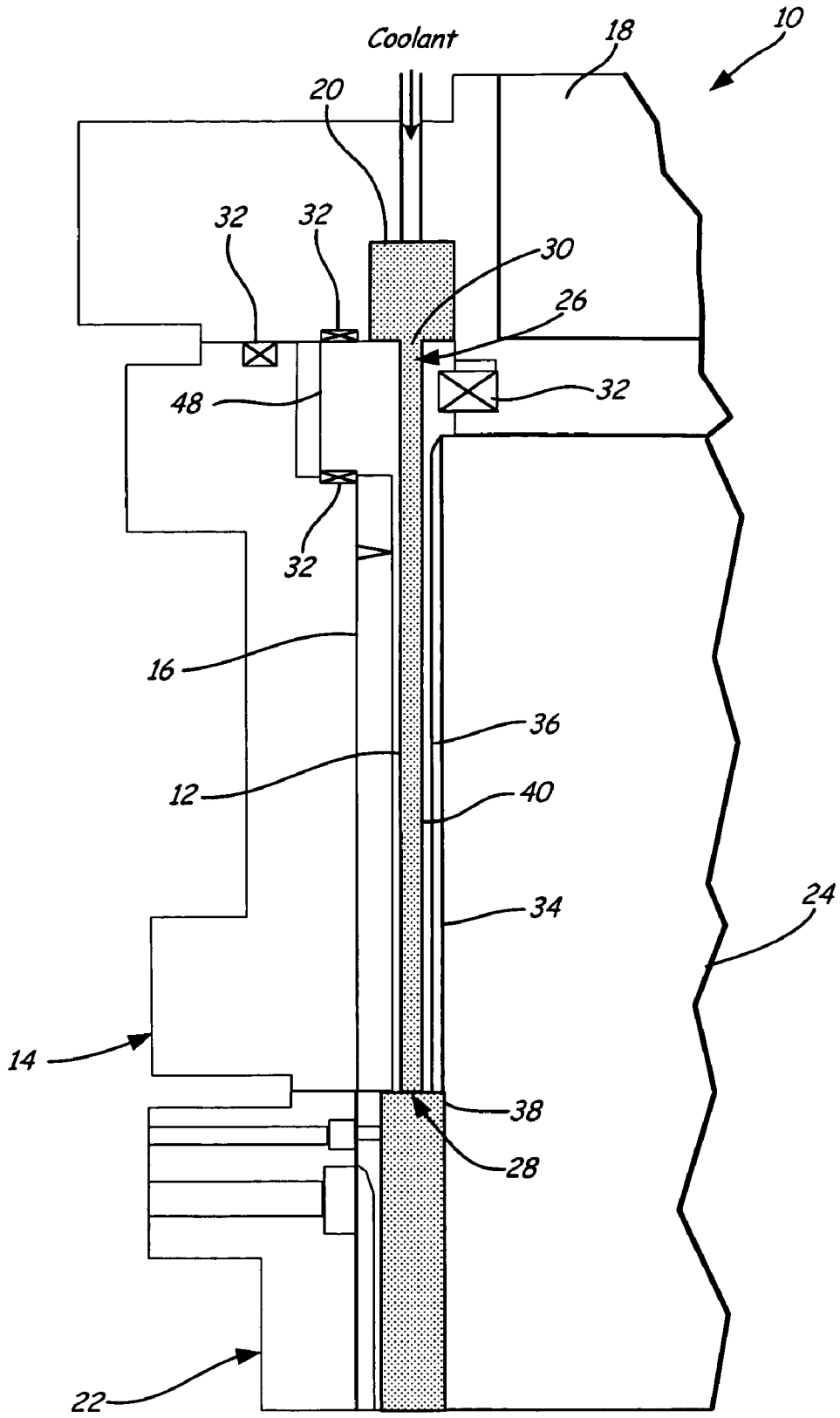
FIG. 1 is a cross-sectional view of a dump-cooled gasifier.

FIG. 1 shows a cross-sectional view of dump-cooled gasifier 10, generally including liner 12, metal pressure vessel 14, insulator 16, injector 18, manifold 20, quench section 22, and reaction chamber 24. Using liner 12 in gasifier 10 offers a low cost alternative to other liners as well as extends the life of gasifier 10. Various technical risks of the gasification process are also reduced by reducing or eliminating metal/ceramic joining issues as well as thermal growth mismatch issues. The configuration of liner 12 in dump-cooled gasifier 10 also allows for the temperature of liner 12 to be directly controlled.

Vessel 14 is positioned above quench section 22 and contains reaction chamber 24. Vessel 14 houses liner 12 and insulator 16 of gasifier. Liner 12 extends along the length of vessel 14 and includes a head end 26, an aft end 28, and an inner diameter 30. Head end 26 of liner 12 is connected to at least vessel 14, injector 18, and manifold 20 by mechanical seals 32 at inner diameter 30 of liner 12. As can be seen in FIG. 1, liner 12 is suspended in vessel 14 such that aft end 28 of liner 12 is not attached to vessel 14 or any other element of gasifier 10. Aft end 28 of liner 12 is thus free to expand and contract both axially and radially in response to any thermal changes within vessel 14. In an exemplary embodiment, liner 12 is between approximately 10 feet and approximately 30 feet in length.

As the temperature inside reaction chamber 24 may reach between approximately 2000° F. (1093° Celsius, ° C.) and approximately 6000° F. (3316° C.), the temperature along liner 12 must be continuously controlled by coolant flowing through liner 12. Insulator 16 is positioned between liner 12 and vessel 14 to help maintain the temperature of liner 12 and vessel 14 within operating limits. A suitable temperature range for liner 12 is between approximately 1000° F. (538° C.) and approximately 2000° F. (1093° C.). A particularly suitable temperature range for liner 12 is between approximately 1200° F. (649° C.) and approximately 1800° F. (982° C.). Although FIG. 1 depicts insulator 16 as being directly attached to liner 12, alternatively insulator 16 may not be directly attached to liner 12.

Manifold 20 is contained between injector 18 and head end 26 of liner 12. To prevent coolant flowing from manifold 20 to liner 12 from leaking into vessel 14 or out of vessel 14 to the atmosphere, liner 12 is sealed at least at inner diameter 30 of liner 12 seals against injector 18, where liner 12 seals against injector 18, where liner 12 seals against vessel 14, and where vessel 14 seals against injector 18. Any metal/ceramic joining issues are eliminated by sealing liner 12 to injector 18, rather than directly to metal pressure vessel 14. The thermal growth mismatch issues between vessel 14, which is formed of metal, and liner 12, which may be formed of a ceramic, ceramic composite, or dissimilar metal, are also prevented by allowing aft end 28 of liner 12 to freely expand and contract. Because aft end 28 of liner 12 is not attached to vessel 14, any thermal growth mismatch is limited to head end 26 of liner 12, which is clamped between vessel 14 and injector 18 by mechanical seals 32. Head end 26 of liner 12 is attached to injector 18 over only a few inches, resulting in manageable loads between injector 18 and liner 12. The thermal expansion of a metal liner is between approximately 5.5E-06 inches per inch per degree Fahrenheit (in/in-° F.) and approximately 8.0E-06 in/in-° F. In comparison, the thermal expansion of a ceramic matrix composite liner is between approximately 1.7E-06 in/in-° F. and approximately 3.3E-06 in/in-° F. In an exemplary embodiment, liner 12 may be formed of materials including, but not limited to: ceramics, ceramic matrix composites, and corrosion-resistant metals. Examples of commercially available corrosion-resistant metals include, but are not limited to: Inconel 625; and Haynes 188 and HR-160, available from Haynes International, Inc., Kokomo, Ind. Although gasifier 10 is discussed as including manifold 20, gasifier 10 may alternatively be constructed without a manifold or with a manifold of different arrangement without departing from the intended scope of the invention.

In operation, coolant flows into manifold 20, where it is introduced into head end 26 of liner 12. Although there may be minor leakage of the coolant at the connection of liner 12 and injector 18, and at the connection of liner 12 and vessel 14, the leakage is acceptable because the coolant will eventually exit into vessel 14. As the coolant passes through liner 12, the coolant picks up heat from reaction chamber 24 and cools liner 12. Because aft end 28 of liner 12 is suspended within vessel 14, the coolant eventually dumps into vessel 14 immediately upstream of quench section 22. Examples of suitable coolants include, but are not limited to: steam, nitrogen, carbon dioxide, and synthesis gas. A suitable temperature range for the coolant is between approximately 100° F. (38° C.) and approximately 1200° F. (649° C.). A particularly suitable temperature range for the coolant is between approximately 600° F. (316° C.) and approximately 1000° F. (538° C.).

The coolant flows through liner 12 at a rate sufficient to freeze a slag layer 34 along an exterior surface 36 of liner 12. Slag layer 34 is formed from the ash content in the carbon-rich fuels flowing through reaction chamber 24. At the high temperatures in which gasifier 10 operates, the ash becomes slag. The temperature of the coolant running through liner 12 is low enough to keep liner 12 at a temperature to freeze slag layer 34 onto exterior surface 36. Slag layer 34 protects liner 12 from abrasion by high velocity particulates and from chemical attack by gas phase reactive species in reaction chamber 24. Alternatively, if slag layer 34 is not deposited along exterior surface 36 of liner 12, liner 12 may be formed of bare metal that is hardened or coated to resist abrasion and that is cooled to achieve surface temperatures capable of withstanding chemical attack.

The exit velocity of the coolant from liner 12 also provides a slag drop lip 38 at aft end 28 of liner 12. Slag drop lip 38 is a result of the high temperature of the coolant exiting at aft end 28 liner 12 and prevents slag from building up at aft end 28 of liner 12. The presence of slag drop lip 38 thus reduces any maintenance time and cost that would be required to remove slag from aft end 28 of liner 12, as well as prevents slag from blocking the coolant from exiting liner 12 and entering quench section 22.

Figure 2:
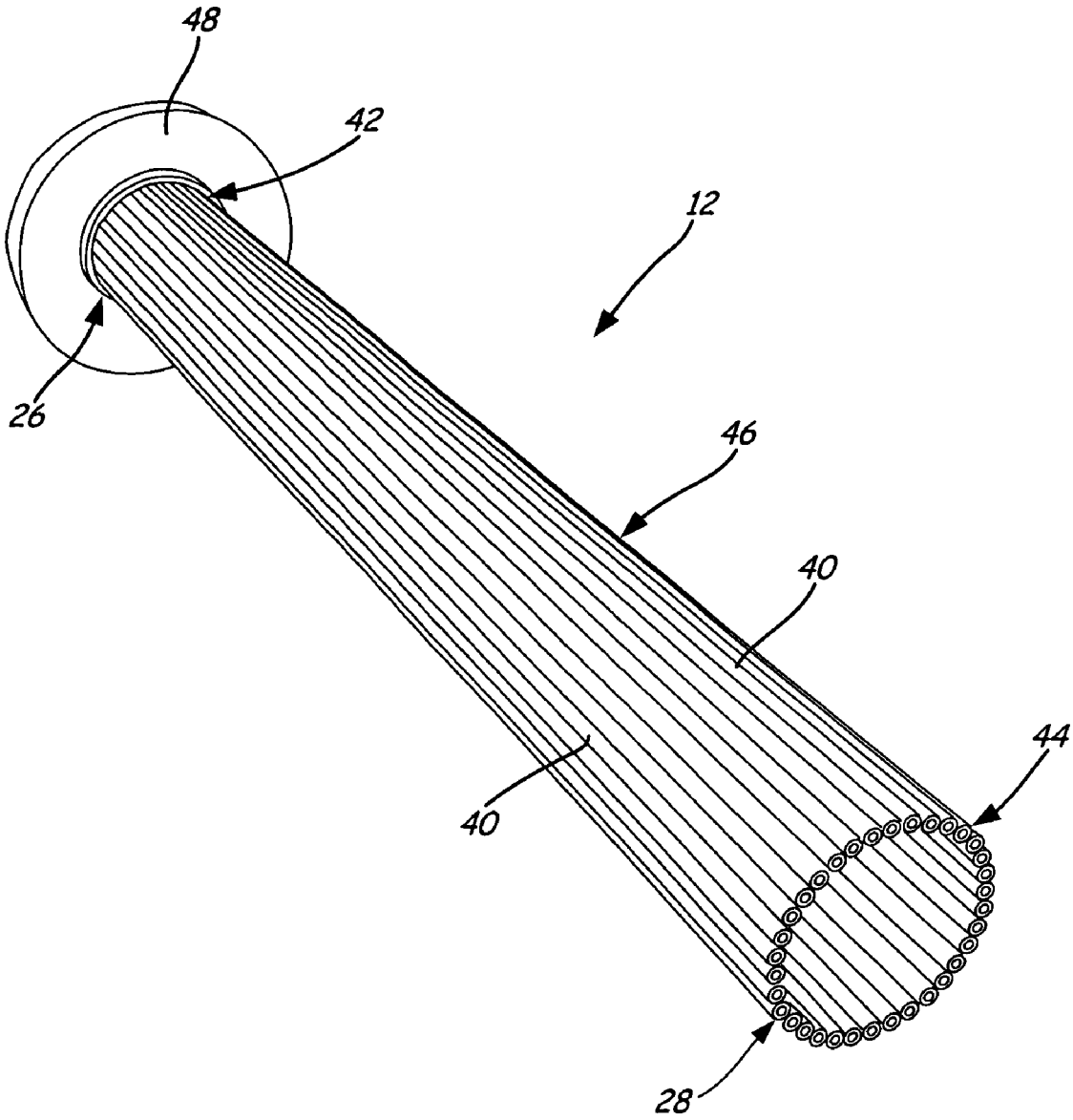
FIG. 2 is a perspective view of a liner of the dump-cooled gasifier.

FIG. 2 shows a perspective view of an exemplary embodiment of liner 12. Liner 12 is a tube wall liner that is fabricated from a plurality of tubes 40 with the coolant flowing through the circular or substantially circular cross-sections of tubes 40. Tubes 40 may be integral or non-integral. Each of tubes 40 has a head end 42, an aft end 44, and a body 46 between the head and aft ends 42 and 44. Tubes 40 are positioned such that head ends 42 and aft ends 44 of all of tubes 40, respectively, are aligned with each other to form a circular cross section. Together, head ends 42 of tubes 40 form head end 26 of liner 12 and together, aft ends 44 of tubes 40 form aft end 28 of liner 12. Thus, head ends 42 of tubes 40 are attached to mounting flange 48, which has a circular shape. In an exemplary embodiment, each of tubes 40 have an inner diameter of between approximately 0.3 inches and approximately 1.5 inches.

As previously mentioned, coolant enters vessel 14 through head end 26 of liner 12. Head ends 42 of tubes 40 accept the coolant, which then flows through bodies 46 of tubes 40 to aft ends 44 of tubes 40. After the coolant has passed through liner 12, the coolant dumps directly into vessel 14 (shown in FIG. 1). The temperature of liner 12 can be directly controlled by adjusting the flow rate of the coolant passing through tubes 40. As the flow rate of the coolant through tubes 40 increases, the temperature of liner 12 decreases. As the flow rate of the coolant through tubes 40 decreases, the temperature of liner 12 increases. In a non-limiting example, when the coolant enters liner 12 at a flow rate of between approximately 0.2 pounds per second (lbs/sec) (0.091 kilograms/second) and approximately 10 lbs/sec (4.54 kilograms/second), per square foot (0.093 square meters) of liner surface area exposed to reaction chamber 24, exterior surface 36 of liner 12 has a temperature of between approximately 1200° F. (649° C.) and approximately 1800° F. (982° C.).

Figure 3:
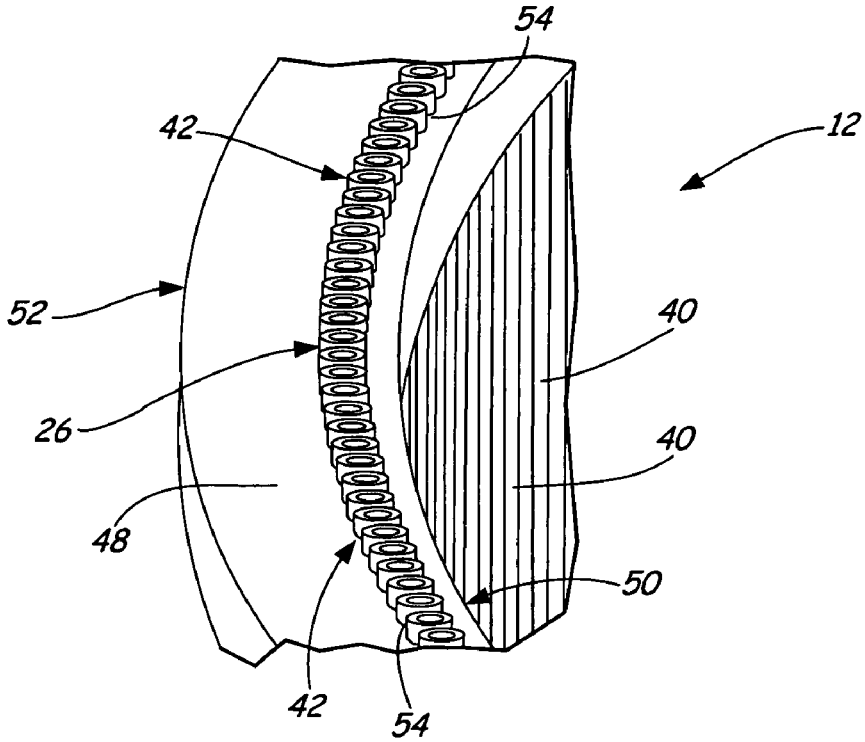
FIG. 3 is an enlarged, partial view of an exemplary embodiment of a tube wall liner of the dump-cooled gasifier.

FIG. 3 shows an enlarged, partial view of head end 26 of liner 12 connected to mounting flange 48. Mounting flange 48 has inner edge 50, outer edge 52, and apertures 54. Apertures 54 are disposed through mounting flange 48 between inner and outer edges 50 and 52 and are positioned immediately next to each. As can be seen in FIG. 3, head ends 42 of tubes 40 pass through apertures 54 such that head ends 42 of tubes 40 protrude slightly from apertures 54 of mounting flange 48. Due to the position of apertures 54, each of tubes 40 is positioned proximate inner edge 50 of mounting flange 48. Although FIG. 3 depicts tubes 40 as having a circular cross-section, tubes 40 may have other cross-sections, including, but not limited to: elliptical and oblong.

Figure 4:
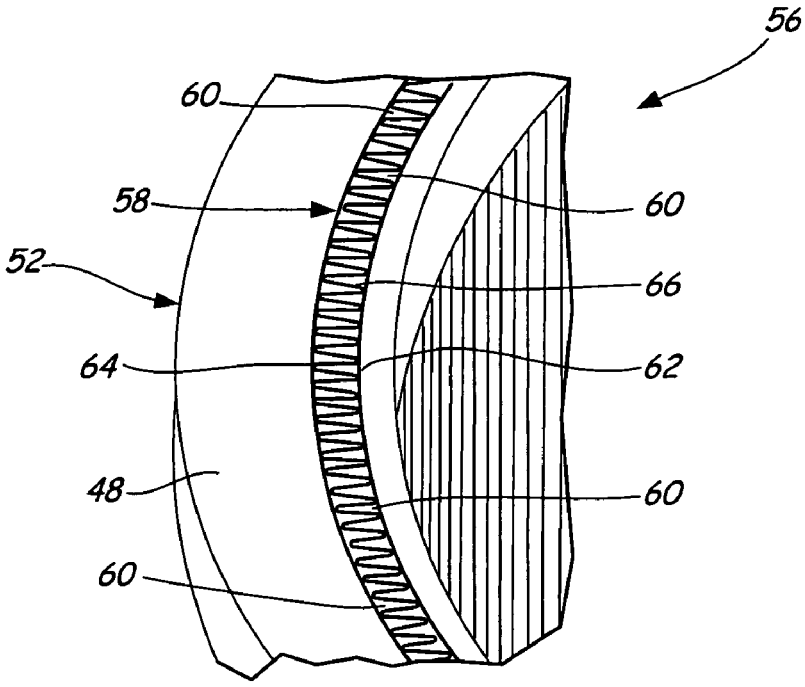
FIG. 4 is an enlarged, partial view of an exemplary embodiment of a channel wall liner of the dump-cooled gasifier.

FIG. 4 shows an enlarged, partial view of an exemplary embodiment of liner 56. Similar to liner 12 shown in FIG. 3, head end 58 of liner 56 is positioned within mounting flange 48. However, rather than a tube wall liner, liner 56 is a channel wall liner with the coolant flowing through a rectangular or substantially rectangular cross section. A plurality of channels 60 of liner 56 are formed by interior wall 62, exterior wall 64, and sheet 66. Sheet 66 is positioned between interior and exterior walls 62 and 64 and is bent to form a serpentine shape. Alternatively, a number of individual sheets 66 may be utilized to create non-serpentine channels 60. The resulting form of sheet 66 within interior and exterior walls 62 and 64 create channels 60. The coolant flows through liner 56 between interior and exterior walls 62 and 64, but is also separated by channels 60.

Figure 5:
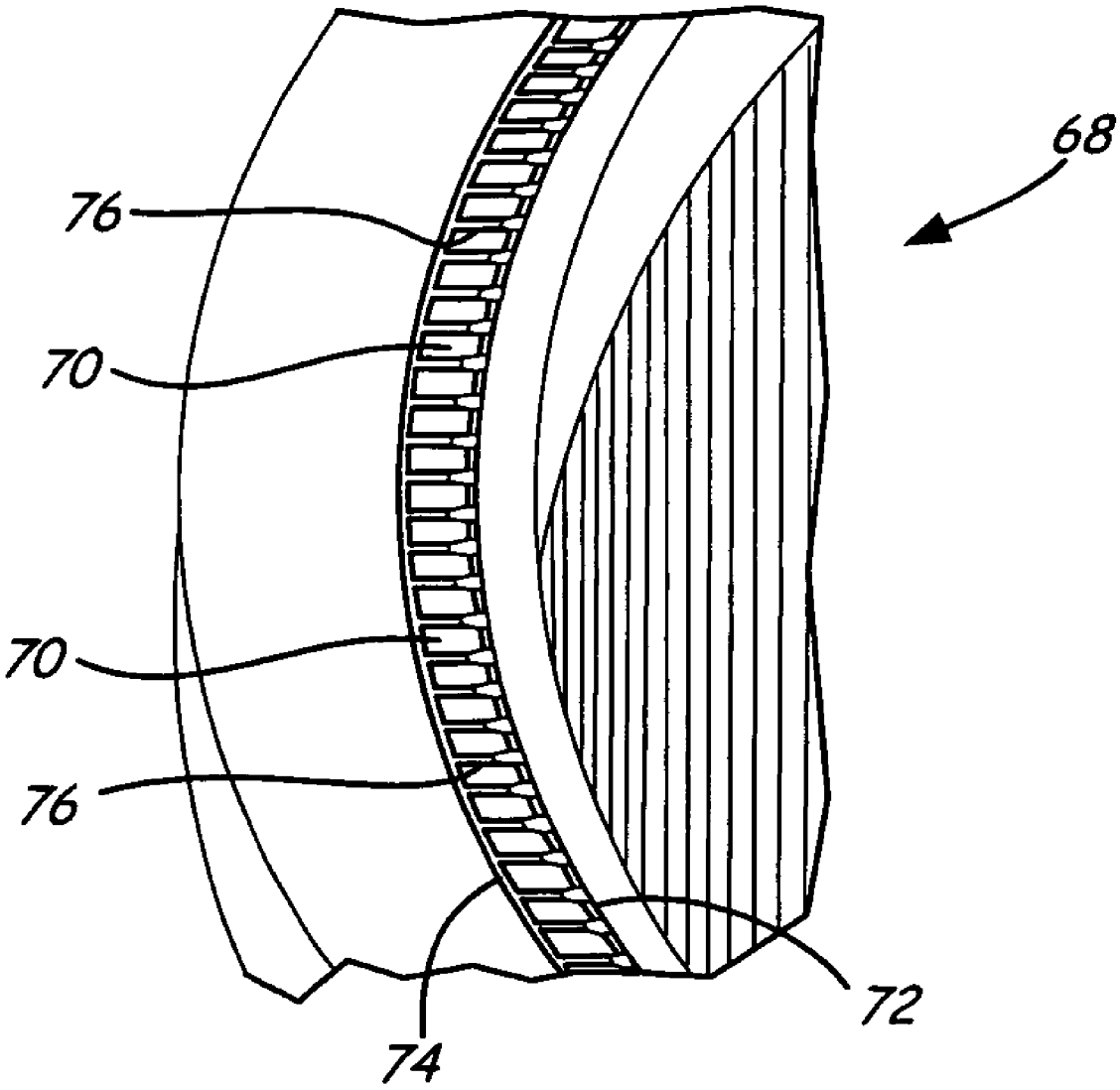
FIG. 5 is an enlarged, partial view of an exemplary embodiment of a channel wall liner of the dump-cooled gasifier.

FIG. 5 shows an enlarged, partial view of an exemplary embodiment of liner 68. Similar to liner 56, liner 68 is also a channel wall liner, with channels 70 having a substantially rectangular cross section. Channels 70 of liner 68 are formed utilizing first cover sheet 72, second cover sheet 74, and mid-walls 76. First and second cover sheets 72 and 74 are positioned substantially parallel to each other with mid-walls 76 positioned between and substantially normal to first and second sheets 72 and 74. Channels 70 are thus formed between the intersection of first sheet 72, second sheet 74, and mid-walls 76. In an exemplary embodiment, channels 70 of liner 68 are formed by a subtractive forming method applied to first sheet 72. For example, channel 70 may be created by laser welding second sheet 74 to first sheet 72.

The dump-cooled gasifier can reduce or eliminate metal/ceramic joining issues as well as thermal growth mismatch issues by using a dump-cooled liner. The liner is formed from a metal, ceramic, or ceramic matrix composite. The liner is bounded at a head end by an injector of the gasifier and is allowed to suspend freely at an aft end. Because the liner is suspended at its aft end, it is allowed to freely expand and contract such that any thermal growth of the liner does not effect the performance or stability of the gasifier. A coolant is introduced into the liner by a manifold and passes through the liner through a plurality of tubes of channels that form the liner. The temperature of the liner can thus be directly controlled by controlling the flow rate of the coolant through the tubes or channels of the liner. After the coolant has passed through the liner, the coolant is dumped into the vessel of the gasifier.

Although the present invention has been described with reference to preferred embodiments, workers skilled in the art will recognize that changes may be made in form and detail without departing from the spirit and scope of the invention.

The invention claimed is:

1. A dump-cooled gasifier comprising:

a vessel containing a reaction chamber;

a liner having a head end, an aft end and a plurality of channels extending along a length of the vessel between a wall of the vessel and the reaction chamber and preventing the reaction chamber from contacting the wall of the vessel, wherein the head end is connected to the vessel and the liner is freely suspended from the head end such that the aft end of the liner is axially and radially expandable with respect to the head end of the liner; and coolant flowing through the liner, entering at the head end of the liner and expelling at the aft end of the liner directly into the vessel, wherein the liner is a channel wall liner having a first sheet and a second sheet that is radially spaced from the first sheet, and wherein the channels are located between the first sheet and the second sheet.

2. The dump-cooled gasifier vessel of claim 1, and further comprising a layer of slag extending along an exterior surface of the liner.

3. The dump-cooled gasifier vessel of claim 1, wherein the liner is formed of at least one of the group consisting of: ceramic and ceramic matrix composite.

4. The dump-cooled gasifier vessel of claim 1, wherein the liner is formed of a corrosion resistant metal.

5. The dump-cooled gasifier vessel of claim 1, and further comprising an injector, wherein the liner and the injector are connected by mechanical seals.

6. A gasifier comprising:

a quench section;

a vessel positioned above the quench section, the vessel having a reaction chamber;

a dump-cooled liner having a plurality of elongated integral channels, a head end connected to the vessel, and an aft end, wherein the liner is freely suspended in the vessel from the head end and wherein the dump-cooled liner separates a wall of the vessel from the reaction chamber; and an opening for introducing a coolant into the dump-cooled liner, wherein the coolant is expelled from the aft end of the dump-cooled liner into the reaction chamber of the vessel immediately upstream of the quench section, and wherein the dump-cooled liner is a channel wall liner having a first sheet and a second sheet that is radially spaced from the first sheet, and wherein the channels are located between the first sheet and the second sheet.

7. The gasifier of claim 6, and further comprising a layer of slag extending along an exterior surface of the liner.

8. The gasifier of claim 6, wherein the dump-cooled liner is formed of at least one of the group consisting of: ceramic and ceramic matrix composite.

9. The gasifier of claim 6, wherein the dump-cooled liner is formed of a corrosion resistant metal.

10. The gasifier of claim 6, and further comprising an injector, wherein the dump-cooled liner and the injector are connected by mechanical seals.

* * * * *